US005097237A

United States Patent [19]

Komazaki et al.

[11] Patent Number: 5,097,237

[45] Date of Patent: Mar. 17, 1992

[54] MICROSTRIP LINE TYPE RESONATOR

[75] Inventors: Tomokazu Komazaki; Katsuhiko Gunji; Norio Onishi; Ichiro Iwase; Akira Mashimo, all of Tokyo, Japan

[73] Assignee: Oki Electric Industry Co., Ltd., Tokyo, Japan

[21] Appl. No.: 566,532

[22] Filed: Aug. 10, 1990

[30] Foreign Application Priority Data

Aug. 14, 1989 [JP] Japan ..... 63-94321[U]

[51] Int. Cl.[5] ..... H01P 1/203; H01P 7/08

[52] U.S. Cl. ..... 333/204; 333/219

[58] Field of Search ..... 333/202-205, 333/219, 246

[56] References Cited

U.S. PATENT DOCUMENTS

| | | | |
|---|---|---|---|
| 4,266,206 | 5/1981 | Bedard et al. | 333/204 |
| 4,703,291 | 10/1987 | Nishikawa et al. | 333/204 X |
| 4,758,922 | 7/1988 | Ishigaki et al. | 361/330 |
| 4,916,417 | 4/1990 | Ishikawa et al. | 333/204 |
| 4,975,664 | 12/1990 | Ito et al. | 333/204 X |

FOREIGN PATENT DOCUMENTS

| | | | |
|---|---|---|---|
| 0383300 | 8/1990 | European Pat. Off. . | |
| 61-28201 | 2/1986 | Japan . | |
| 0161802 | 7/1986 | Japan | 333/204 |
| 0131601 | 6/1988 | Japan | 333/204 |
| 0091502 | 4/1989 | Japan | 333/204 |
| 2139427 | 11/1984 | United Kingdom . | |

OTHER PUBLICATIONS

"A Study of Rectangular Microstrip Resonators", Donald Carlile et al., Archiv fur Elektronik und Ebertragungstechnik, vol. 30, No. 1, Jan. 1976.

"Evaluating Superconducting Resonator Materials", M. R. McAvoy et al., Proceedings of the 42nd Annual Frequency Control Symposium, Jun. 1-3, 1988, Baltimore, U.S., IEEE, New York, U.S., 1988.

"Microstrip Feeds For Prime Focus Fed Reflector Antennas", P. S. Hall et al., IEEE Proceedings H. Microwaves, Antennas & Propagation, vol. 134, No. 2, Apr. 1987.

"800 MHz Band Face-Bonding Filter Using Dielectric B.D.L.S.", T. Nishikawa et al., 1986 IEEE-MTT-S International Microwave Symposium-Digest, Jun. 2-4, 1986, Baltimore, U.S., IEEE, New York, U.S., 1986.

*Primary Examiner*—Eugene R. LaRoche
*Assistant Examiner*—Seung Ham
*Attorney, Agent, or Firm*—Wenderoth, Lind & Ponack

[57] ABSTRACT

A microstrip line type resonator includes a rectangular parallelapiped dielectric plate, and a conductive microstrip line disposed on a top surface of the dielectric plate. The microstrip line has opposite ends respectively spaced from front and rear edges of the dielectric plate. The resonator further includes a first grounding layer disposed on an entirety of the bottom surface of the dielectric plate, and a second grounding layer disposed an entirety of the front, rear and side surfaces of the dielectric plate. The first grounding layer is electrically connected to the second grounding layer at the edges of the bottom surface of the dielectric plate. The microstrip line type resonator is a ½ wavelength resonator.

9 Claims, 6 Drawing Sheets

MICROSTRIP LINE TYPE RESONATOR

REFERENCE TO A RELATED APPLICATION

This application claims the right of priority under 35 U.S.C. 119 of Japanese Utility Model Application Serial No. 94321/89, filed on Aug. 14th, 1989, the entire disclosure of which is incorporated herein by reference.

BACKGROUND OF THE INVENTION

1. Field of the Invention

This invention relates to a microstrip line type resonator, and more particularly, to a microstrip line type resonator structure including a rectangular parallelepiped dielectric plate, a ground conductor layer formed on the bottom, front, rear, and two side surfaces of the plate, and a microstrip line formed on the top surface of the plate.

2. Brief Description of the Related Art

Recently, high frequency microwave band communication technology has played a significant role in mobile communication systems, for example, in the recently developed cellular telephone systems.

In this technology, since communication systems require several hundreds of frequency channels in the approximately 800 MHz frequency band, there has been a need for a small filter, having a high quality factor (high-Q) and a low parasitic capacitance, which is suitable for mass production.

To realize such a filter, a small, high-Q resonator, which is an essential part of the filter, is required. One example of a conventional resonator is disclosed in a U.S. Pat. No. 4,266,206 issued on May 5, 1981.

FIG. 1 illustrates an example of the conventional microstrip line type resonator disclosed in the above mentioned U.S. patent. As shown in FIG. 1, the resonator 10 includes a rectangular dielectric substrate 12 which may be made of ceramic, such as alumina, having a thickness on the order of 0.03 inch. Further, the resonator 10 includes a ground plane conductor 14 on the bottom surface of the substrate 12, a microstrip line 16 on the top surface of the substrate 12, an apron portion 18 provided on the top surface connected to the microstrip line 16 at one end 22 of the microstrip line 16, and a conducting bridge 20 connecting the microstrip line 16 and the ground plane conductor 14 via the apron 18. Dielectric material of the substrate 12 is exposed at a portion of the top surface and two side surface 13*a* and 13*b* thereof.

Generally, this kind of resonator is designed by approximation calculations, and further, is adjusted by trimming based on repeated trial and error of actual measurements of several characteristics of the resonator, such as the quality factor, resonance frequency, and the like.

Publications have been directed to such approximation, some thesis or books have, for example, Wheeler, H. A., "Transmission Line Properties of a Strip on a Dielectric Sheet on a Plane", IEEE Trans. Microwave Theory Tech., Vol. MTT-25, August 1977, pp. 631–647, or Wheeler, H. A., "Transmission Line Properties of a Stripline Between Parallel Planes", IEEE Trans. Microwave Theory Tech., Vol. MTT-26, November 1978, pp. 866–876.

However, since these approximations are based on an ideal model such as that illustrated in FIG. 2 which includes a dielectric plate 28 having infinite area, a grounding conductor 26 provided on the entire bottom surface of the dielectric plate 28, and a microstrip line 24 having an infinite length on the top surface of the dielectric plate 28, the final adjustments must still be conducted to a complete the resonator, which has a limited area, to account for the differences between the ideal resonator model and the actual resonator structure.

Further, to enhance the approximation, the conventional resonators should have similar structure to that of the ideal resonator. On the other hand, since the resonator should be compact for use in high frequency filters featured in mobile telecommunication systems. Further, the electromagnetic fields between the microstrip line and the ground conductor, such as those illustrated as arrow lines (electric field) and broken lines (magnetic field) in FIG. 2, are distrubed by the limited area of the dielectric plate.

In other words, there must be such disturbance of the electromagnetic field in the actual resonator which has at least an exposed dielectric plane at the end of the dielectric plate, for example, the side surface 13*a* and 13*b* shown in FIG. 1. Further, the disturbed electromagnetic fields reduced the quality factor of the resonator.

Therefore, even though it has long been a need for a compact microstrip line type resonator having a high quality factor, the conventional microstrip line type resonator can not realize the desired (High-Q) resonator characteristic.

OBJECTS AND SUMMARY OF THE INVENTION

An object of the present invention is to provide a relatively small microstrip line type resonator having a high quality factor.

Another object of the present invention is to provide a microstrip line type resonator which does not result in as much estimation calculation errors.

Still another object of the present invention to provide a microstrip line type resonator which is suitable for mass production.

To realize the above mentioned objects, there is provided a microstrip line type resonator which includes a rectangular parallelepiped dielectric plate having a first grounding conductor on the bottom surface thereof, a second grounding conductor on the front, rear, and two side surfaces of the dielectric plate which is connected to the first ground conductor, and a microstrip line conductor provided on the top surface of the dielectric plate. The length of the microstrip line conductor can be selected from one of $\frac{1}{2}$ or $\frac{1}{4}$ wave lengths of the frequency of the signal which is applied to the resonator.

Because of the above mentioned structure, the disturbance of the electromagnetic filed is reduced efficiently by the second ground conductor on the front, rear, and two side surfaces and it becomes possible to provide a compact, high-Q microstrip line type resonator.

Explained hereunder several detailed examples of those resonators and detailed electromagnetic characteristic thereof.

BRIEF DESCRIPTION OF THE DRAWINGS

These and other features and advantages of the invention may be more completely understood from the following detailed description of the preferred embodiments of the invention with reference to the accompanying drawings in which:

FIG. 3(*b*) illustrates an actual second example of the ½ resonator of the present invention having an input/output terminal;

FIG. 3(*c*) illustrates a third example of the microstrip line type resonator of the present invention forming a ¼ wave length resonator;

DETAILED DESCRIPTION OF THE INVENTION

(First Embodiment)

Figure 3A:
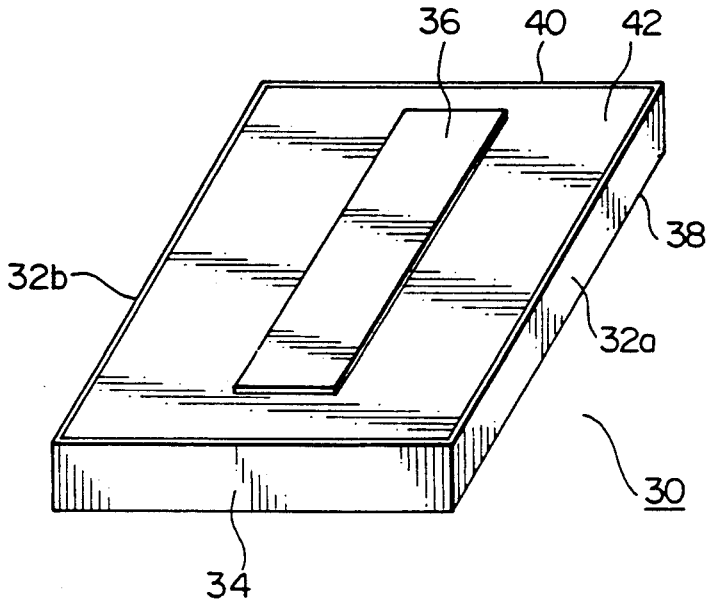
FIG. 3(*a*) illustrates a first example of an ideal microstrip line type resonator of the present invention forming a ½ wave length resonator.
Figure 3B:
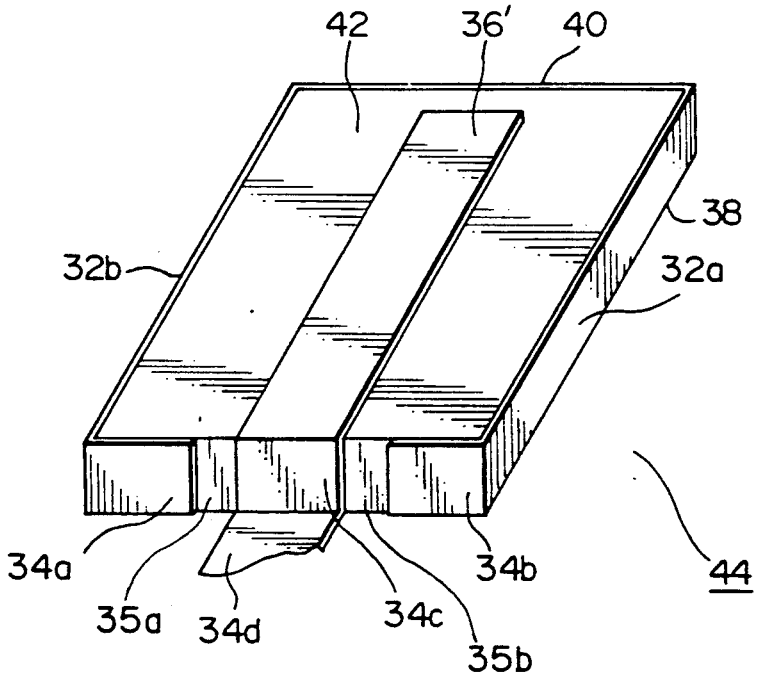
Figure 3C:
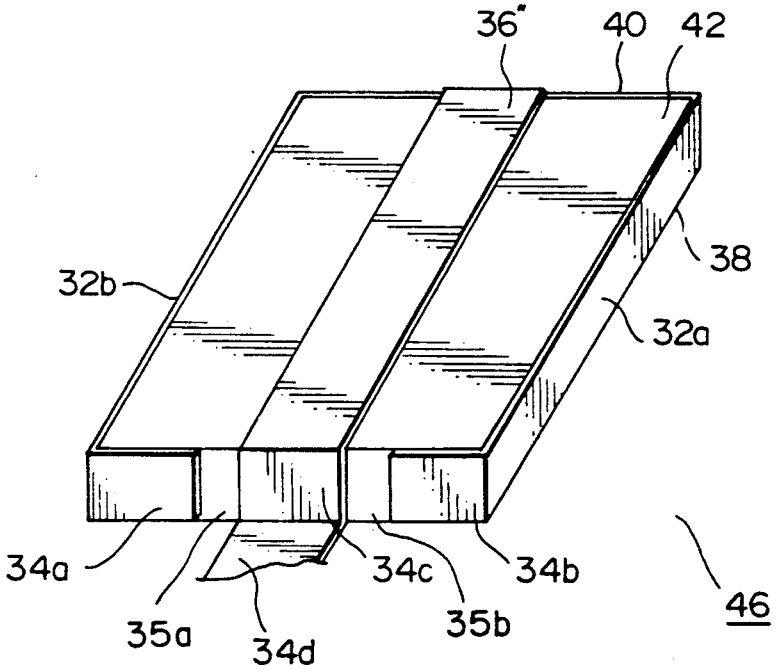

As shown in FIG. 3(*a*), a first embodiment of the present invention includes a rectangular parallelpiped dielectric plate 42 which is made of a ceramic having a dielectric constant of approximately 77.2, a first grounding layer 38 provided by a plating on the entire bottom surface of the plate 42, a second grounding layer provided by a plating on the front surface 34, rear surface 40, and two side surfaces 32*a*, 32*b* of the plate 42.

The first grounding layer and the second grounding layer are connected at the each edges of the bottom surface of the dielectric plate 42 to effect a single combined grounding portion of the resonator 30. Therefore, the dielectric material (such as ceramic) of the dielectric plate 42 is exposed only at the top surface of the plate 42.

Figure 2:
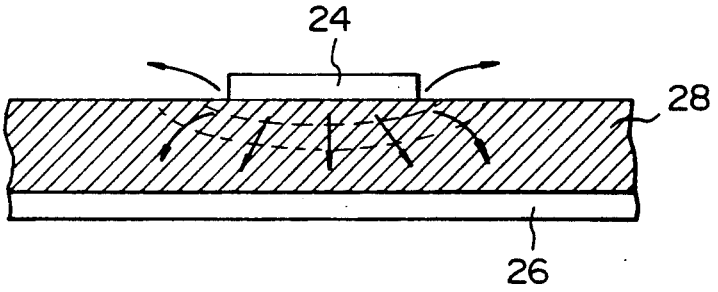
FIG. 2 is a partial sectional view of an ideal microstrip line type resonator.

The length of the microstrip line 36 is a ½ wave length of a signal which is applied thereto. Thus, the microstrip line resonator 30 resonates at a frequency having a ½ wave length which is the same as the length of the microstrip line 36. The resonator 30 is an example of an ideal model of the present invention for estimation calculation, omitting the influence of an input/output terminal, which forms a ½ wave length resonator. According to the inventors' estimation, there does not result as much calculation errors between the ideal model disclosed in FIG. 2 and this embodiment.

(Second Embodiment)

An actual example of the ½ wave length resonator having such the input/output terminal 34*c* is illustrated in FIG. 3(*b*). In FIG. 3(*b*), the same reference numerals denote the same or equivalent elements as illustrated in FIG. 3(*a*).

In FIG. 3(*b*), a part of the second grounding layer 34 on the front surface of the dielectric plate 42 is separated into two guide portions 34*a* and 34*b* for guiding the input/output terminal 34*c* to define slits 35*a* and 35*b*. The input/output terminal 34*c* is provided by a plating on the front surface and is connected to an outer circuit 34*d* (partially omitted) which applies an input signal to the resonator 44 and also receives an output signal from the resonator 44. Further, the input/output terminal 34*c* is connected to one end of a microstrip line 36' at an edge of the top surface of the dielectric plate 42.

As mentioned above, even though the entire bottom surface of the dielectric plate 42 is covered by a first grounding layer 38, the input/output terminal 34*c* and the outer circuit 34*d* are electrically separated from the first grounding layer 38 by a small slot (not shown; located on a reverse side of a connecting point between the input/output terminal 34*c* and the outer circuit 34*d*) on the front surface which is adjacent to an edge of the bottom surface to prevent a short circuit.

Since the first and second grounding portions, the microstrip line 36', and the input/output terminal 34*c* can be made by plating of a conductive material, such as silver, it is relatively easy to manufacture the resonator 44 by mass-production.

(Third Embodiment)

FIG. 3(*c*) illustrates a third embodiment of the present invention which forms a ¼ wave length resonator 46. In FIG. 3(*c*), the same reference numerals denotes the same or equivalent elements as illustrated in FIG. 3(*a*) or in FIG. 3(*b*).

The microstrip line type resonator 46 disclosed in FIG. 3(*c*) is a ¼ wave length resonator. Therefore, the length of a microstrip line 36'' on the dielectric plate 42 is a ¼ wave length of a signal which is applied to an input/output terminal 34*c* to resonate at a frequency having a ¼ wave length which is the same as the length of the microstrip line 36''.

The main difference between the ¼ wave length resonator 46 disclosed in FIG. 3(*c*) and the ½ wave length resonator 44 disclosed in FIG. 3(*b*) is that one end of the microstrip line 36'' of the ¼ resonator 46 is connected to the second grounding layer 40 at the rear surface of the resonator 46.

(Analysis)

As described in "BACKGROUND OF THE INVENTION", analysis of a microstrip line resonator is very difficult and there exists only few estimation calculation methods. Therefore, the present invention can be evaluated only by experimental results.

Figure 4:
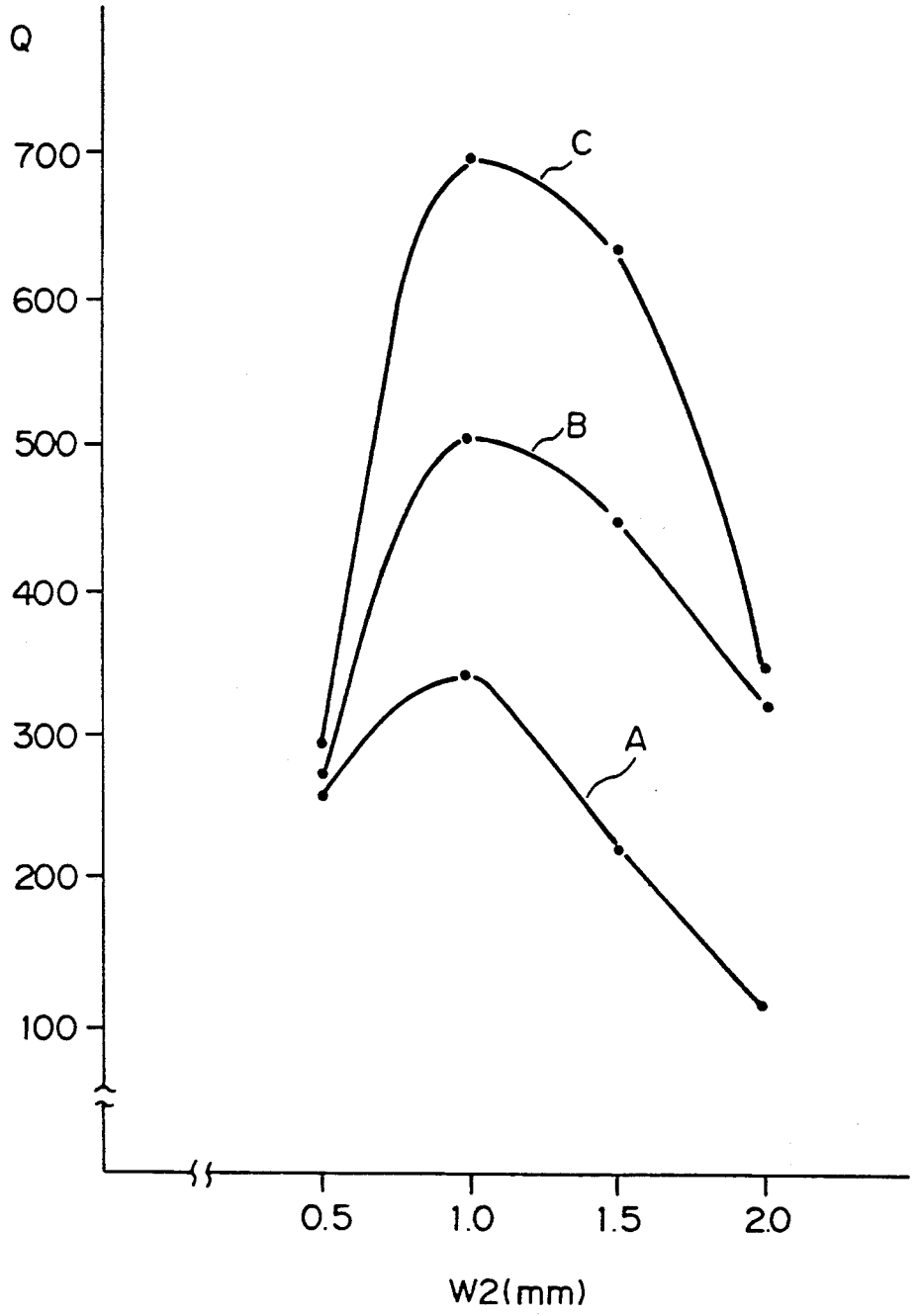
FIG. 4 is a graph for explaining improved quality factor characteristics of the ½ wave length resonators of the present invention.

FIG. 4 illustrates an example of such results describing advantages of a microstrip line resonator of the present invention.

Figure 1:
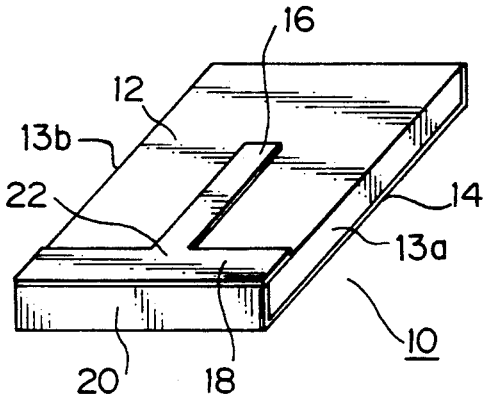
FIG. 1 illustrates a conventional strip line type resonator disclosed in U.S. Pat. No. 4,266,206.

In this experiment, we tested three ½ wave length resonators A, B, and C each having a structure similar to the resonator disclosed in FIG. 3(*a*). Each of the resonators had a width (W1) of 5.0 mm, length (L) of 24.0 mm, and height (H) of 1.5 mm. The thickness (t) of each of grounding portions and the microstrip lines was approximately 10 microns. Further, as for two of the resonators, we put another dielectric plate on the top surface thereof to cover the microstrip line resulting in a tri-plate type structure. The tri-plate structure itself is a conventional structure as disclosed, for example, in FIG. 1 of the above mentioned U.S. Pat. No. 4,266,206.

In detail, resonator A is a microstrip line type resonator of the present invention having the second grounding layer on the front, rear, and two side surfaces without an above mentioned other dielectric plate. Resonator B is a conventional tri-plate type resonator without the second grounding layer on the two the side surfaces. Resonator C is the tri-plate type resonator having the second grounding layer on the front, rear, and two side surfaces.

We put an end of a testing cable (15 cm) at one end of the microstrip line to apply/receive a test signal and measured the resonance frequency and quality factor of each resonator while changing the width (W2) of the microstrip line.

According to the results of our experiment, at a point that W2 is 1.0 mm, each of tested resonators had maximum quality factor. In detail, resonator A resonated at a frequency of 1.037 GHz and had a quality factor of 344.8. Resonator B resonated at a frequency of 1.100 GHz and had a quality factor of 500.0. Resonator C resonated at a frequecy of 1.076 GHz and had a quality factor of 692.0.

According to an estimation calculation, a conventional microstrip line type resonator having the same size as the tested resonators would have a quality factor of approximately less than 100.

Therefore, it can be realized that the microstrip line type resonator of the present invention can provide approximately a three times higher quality factor than that of the conventional microstrip line type resonator. Further, comparing with two of characteristics of resonator B and C, it can be realized that a part of the second grounding layer such as 32*a* and 32*b* shown in FIG. 3(*a*) significantly improve the quality factor even in the tri-plate type structure.

According to other experiments conducted by the inventors, a tendency of those characteristics may be similar to that of a coaxial resonator rather than that of microstrip line type resonator. We assumed that the second grounding layer on the front, rear, and two side surfaces reduced the disturbance of the electromagnetic field between the microstrip line and the grounding portion and this is why the characteristic of the microstrip line resonator of the present invention is similar to that of the coaxial resonator whose inner conductor is surrounded by an outer conductor.

These results have not been discovered by using a conventional resonator lacking the second grounding layer on two of the side surfaces.

(Fourth Embodiment)

Figure 5:
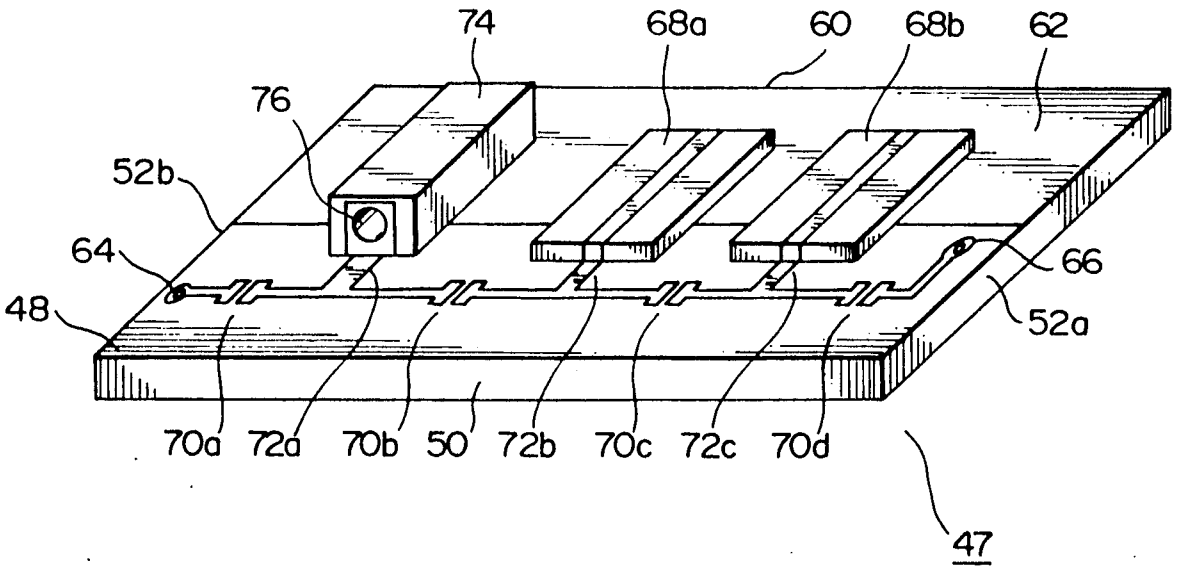
FIG. 5 illustrates an example of a dielectric filter mainly comprised of the resonators of the present invention.
Figure 6:
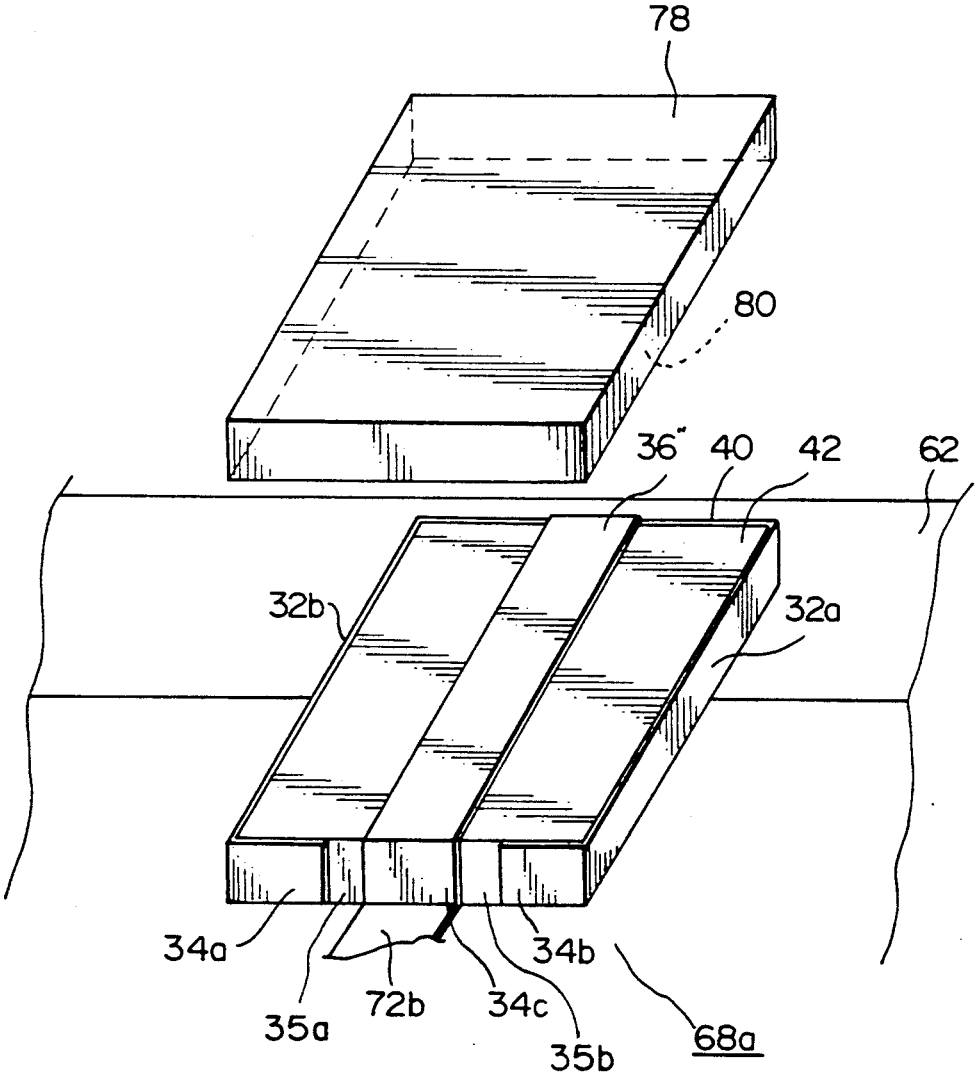
FIG. 6 illustrates a partial magnified view of a modification of the resonator used in FIG. 5 as a tri-plate type dielectric resonator.

Explained hereunder is an application of the present invention with reference to FIG. 5 and FIG. 6.

As shown in FIG. 5, the microstrip line type resonator of the present invention can be used to form a dielectric filter utilized in high frequency band communication technology.

In FIG. 5, a hybrid dielectric filter 47 is mainly made up of two microstrip line type resonators 68*a*, 68*b* and one coaxial resonator 74. Those resonators are mounted on a dielectric plate 48 whose front surface 50, rear surface 60, two side surfaces 52*a*, 52*b*, and a part of the top surface 62 are metalized by plating for grounding.

Further, the resonators 74, 68*a*, and 68*b* are connected to input/output leads 72*a*, 72*b*, and 72*c* made by plating respectively. Further, the microstrip line type resonator 68*b* is coupled to an input terminal (through hole) 52*a* via a coupling capacitor 70*d* and the resonator 68*b* is also coupled to the microstrip line type resonator 68*a* via a coupling capacitor 70*c* and the resonator 68*a* is coupled to a coaxial resonator 74 via a coupling capacitor 70*b* and the coaxial resonator 74 is further coupled to a output terminal (through hole) 64 via a coupling capacitor 70*a*.

Since the microstrip line type resonators 68*a*, 68*b* have high quality factor, it is possible to form a high quality factor dielectric filter suitable for high frequency band communication.

(Sixth Embodiment)

FIG. 6 illustrates an improvement of the dielectric filter disclosed in FIG. 5. As described in the explanation of our experiment, it is possible to increase the quality factor of the resonators by means of a tri-plate structure. In this embodiment, we put another dielectric plate 78 which is entirely covered with a conductive material, such as silver plating, except at a bottom surface 80, on the microstrip line type resonator 68*a*. Of course, the other microstrip line type resonator 68*b* can have the same structure.

According to this structure, it is possible to increase entire quality factor of the filter 47.

What is claimed is:

1. A hybrid dielectric filter comprising:

(1) a first dielectric plate having a top surface, a grounding layer disposed on a portion of the top surface of the first dielectric plate, and a plurality of input/output leads disposed on a remaining portion of the top surface of the first dielectric plate, (2) a plurality of microstrip line type resonators disposed on said first dielectric plate, each of said microstrip line type resonators including:

(a) a second dielectric plate, (b) a conductive microstrip line disposed on a top surface of the second dielectric plate, one end of the microstrip line extending to an edge of the second dielectric plate, and another end of the microstrip line being connected to one of said plurality of input/output leads, and (c) a second grounding layer covering an entirety of a bottom and side surfaces of the second dielectric plate except for surface portions of the second dielectric plate which are electrically connected to said one of said plurality of input/output leads, said second grounding layer being connected electrically to said first grounding layer and to said one end of the microstrip line, (3) an input terminal coupled to one of said input/output leads via capacitor coupling, and an output terminal coupled to another one of said input/output leads via capacitor coupling, and (4) means for coupling adjacent pairs of said plurality of input/output leads via capacitor coupling.

2. A hybrid dielectric filter as recited in claim 1, wherein each of said plurality of microstrip line resonators is a ¼ wavelength resonator.

3. A hybrid dielectric filter as recited in claim 1, wherein each of said plurality of microstrip line resonators further comprises a third dielectric plate having a conductive layer disposed on an entirety of a top surface and each side surface thereof, and having a bottom surface disposed along said top surface of said second dielectric plate.

4. A hybrid dielectric filter as recited in claim 2, wherein each of said plurality of microstrip line resonators further comprises a third dielectric plate having a conductive layer disposed on an entirety of a top surface and each side surface thereof, and having a bottom surface disposed along said top surface of said second dielectric plate.

5. A hybrid dielectric filter comprising:

(1) a first dielectric plate having a top surface, a grounding layer disposed on a portion of the top surface of the first dielectric plate, and a plurality of input/output leads disposed on a remaining portion of the top surface of the first dielectric plate, (2) a plurality of microstrip line type resonators disposed on said first dielectric plate, each of said microstrip line type resonators including:

(a) a second dielectric plate, (b) a conductive microstrip line disposed on a top surface of the second dielectric plate, one end of the microstrip line being spaced apart from an edge of the second dielectric plate, and another end of the microstrip line being connected to one of said plurality of input/output leads, and (c) a second grounding layer covering an entirety of a bottom and side surfaces of the second dielectric plate except for surface portions of the second dielectric plate which are electrically connected to said one of said plurality of input-/output leads, said second grounding layer being connected electrically to said first grounding layer, (3) an input terminal coupled to one of said input/output leads via capacitor coupling, and an output terminal coupled to another one of said input/output leads via capacitor coupling, and (4) means for coupling adjacent pairs of said plurality of input/output leads via capacitor coupling.

6. A hybrid dielectric filter as recited in claim 5, wherein each of said plurality of microstrip line resonators is a ½ wavelength resonator.

7. A hybrid dielectric filter as recited in claim 5, wherein each of said plurality of microstrip line resonators further comprises a third dielectric plate having a conductive layer disposed on an entirety of a top surface and each side surface thereof, and having a bottom surface disposed along said top surface of said second dielectric plate.

8. A hybrid dielectric filter as recited in claim 6, wherein each of said plurality of microstrip line resonators further comprises a third dielectric plate having a conductive layer disposed on an entirety of a top surface and each side surface thereof, and having a bottom surface disposed along said top surface of said second dielectric plate.

9. A microstrip line type resonator comprising:

(a) a rectangular parallelpiped dielectric plate having opposite top and bottom surfaces, opposite first and second side surfaces, and opposite front and rear surfaces;

(b) a conductive microstrip line disposed on the top surface of the dielectric plate, the microstrip line having opposite ends spaced respectively apart from front and rear edges of the dielectric plate which are respectively defined by the front and rear surfaces of the dielectric plate;

(c) a first grounding layer disposed on an entirety of the bottom surface of the dielectric plate; and (d) a second grounding layer disposed on an entirety of the front, rear, and first and second side surfaces of the dielectric plate and connected to the first grounding layer at each edge of the bottom surface of the dielectric plate;

whereby, said microstrip line type resonator is a ½ wave length resonator.

* * * * *